US010024012B1

(12) United States Patent
Williams

(10) Patent No.: US 10,024,012 B1
(45) Date of Patent: Jul. 17, 2018

(54) SNOW MELTING AND REMOVAL VEHICLE

(71) Applicant: Vyvyan G. Williams, Vankleek Hill (CA)

(72) Inventor: Vyvyan G. Williams, Vankleek Hill (CA)

( * ) Notice: Subject to any disclaimer, the term of this patent is extended or adjusted under 35 U.S.C. 154(b) by 0 days.

(21) Appl. No.: 15/607,112

(22) Filed: May 26, 2017

(51) Int. Cl.

| | |
|---|---|
| ***E01H 5/10*** | (2006.01) |
| *E01H 5/00* | (2006.01) |
| *B08B 3/10* | (2006.01) |
| *F24H 1/06* | (2006.01) |

(52) U.S. Cl.
CPC ..... *E01H 5/10* (2013.01); *E01H 5/102* (2013.01); *E01H 5/104* (2013.01); *B08B 3/10* (2013.01); *E01H 5/00* (2013.01); *F24H 1/06* (2013.01)

(58) Field of Classification Search
CPC ..... E01H 5/10; E01H 5/102; E01H 5/104; E01H 5/00; F24H 1/06; B08B 3/10
See application file for complete search history.

(56) References Cited

U.S. PATENT DOCUMENTS 3,327,659 A 6/1967 Nolan et al.
3,410,262 A * 11/1968 Quallsv ..... E01H 5/10 126/271.2 R
3,456,368 A * 7/1969 Lucien ..... E01H 1/108 126/343.5 R
3,803,732 A 4/1974 Moreno
3,866,340 A * 2/1975 Krickovich ..... E01H 5/098 126/343.5 R
4,071,966 A 2/1978 Cohen
5,235,762 A * 8/1993 Brady ..... E04D 13/103 126/343.5 R
5,266,220 A 11/1993 Hammond et al.
5,561,921 A * 10/1996 Vanderlinden ..... E01H 1/001 15/78
5,588,231 A 12/1996 Mavrianos
5,630,286 A * 5/1997 Vanderlinden ..... E01H 1/001 15/322
5,787,613 A * 8/1998 Derome ..... E01H 5/104 126/343.5 R
5,953,837 A * 9/1999 Clifford ..... E01H 5/104 126/343.5 R
6,223,742 B1 * 5/2001 Macameau ..... E01C 19/05 126/343.5 R
6,305,105 B1 10/2001 Lowman
(Continued)

*Primary Examiner* — Jamie L McGowan
(74) *Attorney, Agent, or Firm* — Dale J. Ream

(57) ABSTRACT

A snow melting and removal vehicle includes a vehicle body that is drivable. A primary chamber is situated inside the vehicle and defines an open area. A collection assembly includes an auger configured to collect the snow from the ground surface and deposit the snow into the primary chamber. A heating assembly surrounds the primary chamber for imparting heat to the primary chamber when energized so as to melt the snow therein. The primary chamber and the vehicle body define outlet openings for releasing the melted snow away from the primary chamber and vehicle body. A filter assembly intermediate the collection assembly and primary chamber includes a filter grate rotatably coupled to the primary chamber and configured to rotate to block debris from entering the primary chamber. A collection chamber is downwardly adjacent the grate and is configured to collect solid debris blocked by the filter grate.

20 Claims, 14 Drawing Sheets

(56) References Cited

U.S. PATENT DOCUMENTS

| | | | | |
|---|---|---|---|---|
| 6,474,007 | B1 | 11/2002 | Sueshige et al. | |
| 7,380,355 | B2 * | 6/2008 | Donaldson | E01H 4/023 37/219 |
| 7,814,898 | B2 | 10/2010 | Rumbaugh | |
| 2004/0074114 | A1 * | 4/2004 | Rogers | E01H 5/104 37/228 |
| 2009/0217554 | A1 * | 9/2009 | Tucker | E01H 5/102 37/228 |
| 2010/0313451 | A1 | 12/2010 | Trubiano | |

* cited by examiner

SNOW MELTING AND REMOVAL VEHICLE

BACKGROUND OF THE INVENTION

This invention relates generally to snow removal equipment and, more particularly, to a vehicle specifically outfitted and configured to collect snow from a ground surface, filter solid debris into a collection container, heat and melt the snow, and release the melted snow into a storm drain or onto the ground.

Large snowfalls onto the streets of big cities have the potential to grind commerce, businesses, schools, and transportation to a halt. Even if snow plows are able to move up and down the streets, the resulting piles of snow can make matters worse, such as by burying parked cars or making walls of snow that narrow the streets to a single path. The enormous piles of snow sometimes take weeks or months to melt and otherwise cause great frustration to residents and motorists. In some cities, the snow may be collected into dump trucks and accumulated in massive piles in parking lots or other designated locations.

Although various devices have been proposed in the art, the collection of snow pushed or dumped into massive piles is inefficient, causes significant overcrowding of the streets, and is unsightly for weeks or months. Therefore, it would be desirable to have a mobile snow melting and removal vehicle that collects snow into a primary chamber where it is agitated and heated to a point of melting and then selectively released from the primary chamber. Further, it would be desirable to have a mobile snow melting and removal vehicle that filters solid debris from collected snow before the collected snow is melted and released.

SUMMARY OF THE INVENTION

A snow melting and removal vehicle for collecting snow from a ground surface according to the present invention includes a vehicle body and a propulsion assembly for selectively moving the vehicle body. A primary chamber is situated inside the vehicle and defining an open area. A collection assembly is in fluid communication with the primary chamber and includes an auger configured to collect the snow from the ground surface and deposit the snow into the open area of the primary chamber. A heating assembly surrounds the primary chamber and is configured to impart heat to the primary chamber when energized so as to melt the snow deposited into the primary chamber. The primary chamber and the vehicle body define outlet openings, respectively, configured to release the melted snow away from the primary chamber and the vehicle body.

A filter assembly is positioned intermediate the collection assembly and the primary chamber, the filter assembly having a filter grate rotatably coupled to the primary chamber and configured to rotate when energized and to block solid debris from passing into the open area of the primary chamber. The filter assembly includes a collection chamber downwardly adjacent the filter grate and in operative communication therewith, the collection chamber configured to collect solid debris blocked by the filter grate.

Therefore, a general object of this invention is to provide a snow melting and removal vehicle that collects snow from a surface, melts the snow to water, and releases the water into a sewer drain or onto the ground.

Another object of this invention is to provide a snow melting and removal vehicle, as aforesaid, that includes a rotating filter assembly that filters solid debris from the collected snow and directs solid debris to a collection chamber for later removal.

Still another object of this invention is to provide a snow melting and removal vehicle, as aforesaid, that includes a heating assembly that surrounds a primary chamber of collected snow and that is configured to supply heat to the chamber.

Other objects and advantages of the present invention will become apparent from the following description taken in connection with the accompanying drawings, wherein is set forth by way of illustration and example, embodiments of this invention.

DESCRIPTION OF THE PREFERRED EMBODIMENT

Figure 1A:
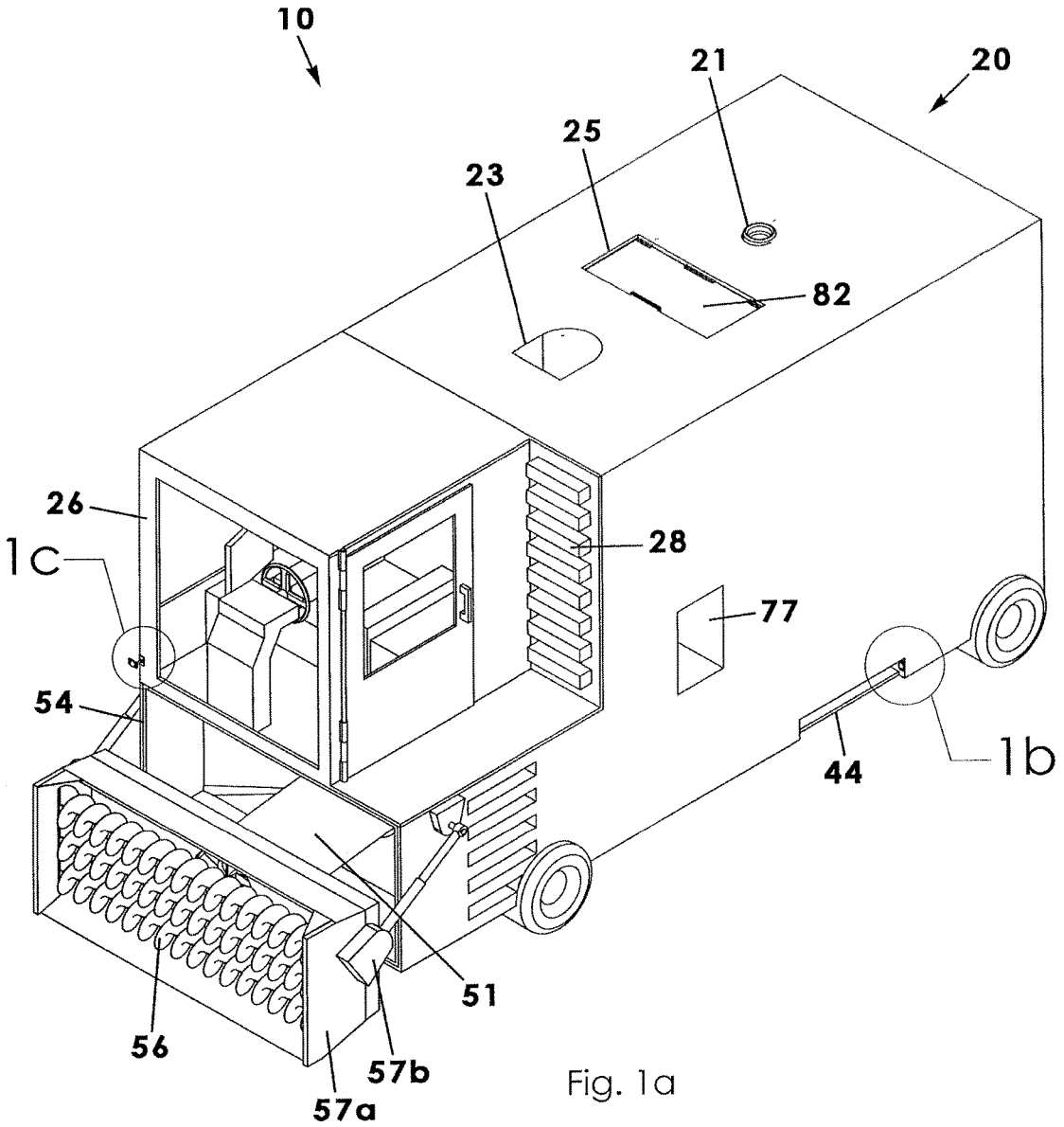
FIG. 1*a* is a perspective view of a snow melting and removal vehicle according to a preferred embodiment of the present invention.

A snow melting and removal vehicle for collecting snow from a ground surface according to a preferred embodiment of the present invention will be described in detail with reference to FIGS. 1*a* to 10 of the accompanying drawings. The snow melting and removal vehicle 10 includes a vehicle body 20, a collection assembly 50, a primary chamber 30, a heating assembly, and a filter assembly 70.

As shown in the drawings, the vehicle body 20 may be configured in the form of a heavy duty truck that is self-sufficient to drive along city streets. More particularly, the vehicle body 20 may include a top wall 22 and a plurality of side walls 24 extending downwardly from respective peripheral edges of the top wall 22, thus forming the vehicle profile. A conventional vehicle propulsion system may be operatively coupled to the vehicle body 20 and configured to enable the vehicle body 20 to be driven, the propulsion system including a motor, transmission, wheels, and a steering mechanism. The vehicle body 20 may include a forward cabin 26 in which a driver may operate the vehicle. Ladders 28 may be coupled to outer surfaces of the vehicle body 20 to enable the driver or other workers to access various components of the vehicle as will be described in more detail later.

It is understood the vehicle propulsion system may include a battery or other power source 12 for vehicle operation and that is also electrically connected to the augers, heating assembly, and other electric or electronic components below. Other electronics, motors, and controls may also be contemplated as would be understood by persons of ordinary skill in the art.

The primary chamber 30 is a container or reservoir structure situated inside the vehicle body 20 and is configured to receive a quantity of snow collected from the ground outside the vehicle body. In an embodiment, the primary chamber 30 may have a continuous side wall 32 that defines a generally cylindrical shape configuration although a rectangular or square configuration would also work. The primary chamber 30 may include a closed bottom and a partially open top as will be described further later.

The collection assembly 50 is a mechanism configured to collect snow from the ground surface and to direct and deposit the collected snow into the primary chamber 30 where it is melted and then released. More particularly, the collection assembly 50 includes a conduit 52 having a receiving member 53 defining a front opening 54 adjacent the vehicle cabin 26 into which collected snow is received into the vehicle body 20. At least one collection auger 56 (or, preferably a plurality of augers) are positioned proximate the front opening 54 of the conduit 52 that are configured to rotate so as to pull snow into the conduit 52 and eventually into the primary chamber 30. The conduit includes a terminal end 58 inside the vehicle body 20 adjacent an inlet opening to the primary chamber 30.

In an embodiment, the collection assembly 50 includes a snow plow member 57*a* pivotally coupled to the receiving member 53, such as with pivot arms 57*b*. The snow plow member 57*a* is positioned to frontwardly of the cabin 26 and is configured to collect snow from a street and direct it to the augers 56 and into the conduit 52. It is understood that a driver of the vehicle 10 is able to actuate the snow plow member 57*a* from the cabin 26 to move up or down (i.e. by actuating the pivot arms) as appropriate for efficient snow collection. More particularly, the augers 56 are positioned proximate a front of the snow plow member 57*a*. The snow plow member 57*a* has side and rear walls, the rear wall defining an opening 57*c* through which snow collected by the snow plow member 57*a* and passed through the augers 56 is passed to the front opening 54 of the receiving member 53. An auxiliary auger 57*d* may be situated in or proximate to the opening 57*c* to enhance movement of snow collected by the snow plow member 57*a* into the conduit 52. Further, an auxiliary material sleeve 51 may interconnect the opening 57*c* to the main conduit 52. In an embodiment, a vertical auger assembly (not shown) may be situated within the conduit 52 configured to further enhance vertical movement of collected snow between the snow plow member 57*a* and entry into the primary chamber 30 described below.

The primary chamber 30 may include structures to mix, stir, and "antagonize" collected snow so that, in combination with heat, the snow is urged to melt so that it may be released from the primary chamber 30, such as into a storm sewer under a city street. More particularly, the primary chamber 30 may include a rod 34 centrally situated in the open area and extending upwardly, e.g. vertically, so as to define an imaginary vertical axis therein. A plurality of counter-rotating agitator members 36 is axially coupled to the rod 34 and configured to be rotated about the vertical axis. Each agitator member 36 may have a configuration like that of a propeller or fin, each agitator member 36 being spaced apart along said rod 34 from an adjacent agitator member 36. Further, each agitator member 36 is configured to rotate in a direction opposite the rotational direction of an adjacent agitator member 36, e.g. clockwise or counter-clockwise.

The primary chamber 30 may include an upper chamber portion 38 in which the agitator members 36 are positioned. Further, the primary chamber 30 may include a lower chamber portion 40 downwardly adjacent and in fluid communication with the upper chamber portion 38. A primary chamber grate 42 may be positioned between (i.e. intermediate) the upper and lower chamber portions. The primary chamber grate 42 is permeable so that the collected snow is held in the upper chamber portion 38 atop the primary grate 42 while in a frozen state whereas it passes into the lower chamber portion 40 as it melts. It is understood that both the primary chamber 30 and vehicle body 20 includes corresponding outlet openings 44 configured to selectively expel water (i.e. melted snow) from the lower chamber portion 40 of the primary chamber 30.

The heating assembly 60 is positioned inside the vehicle body 20 adjacent the primary chamber 30. Preferably, the heating assembly 60 substantially surrounds the primary chamber 30 and is configured to impart and apply heat to the primary chamber 30 whereby to melt collected snow therein. More, particularly, the heating assembly 60 may include a housing 62 having a generally cylindrical housing 62 or other configuration substantially similar to that of the primary chamber 30. The dimensions of the heating assembly 60 are slightly larger than those of the primary chamber 30 so as to substantially surround the primary chamber 30.

The heating assembly 60 may also include a plurality of nozzles 64 in operative communication with a heating source, such as a propane container 66 and related heating components although electric heaters, natural gas, or other heat sources are possible. The propane container 66 may be upwardly adjacent the primary chamber 30 and operably coupled to the plurality of nozzles 64. The plurality of nozzles 64 may be spaced apart along an inner surface of the housing 62 and in close proximity to an outer surface of the side wall 32 of the primary chamber 30 such that the primary chamber 30 is heated when the nozzles 64 are actuated to output heat. In addition, the vehicle body 20 may include a propane refill port 21 in communication with the propane container 66.

Figure 4A:
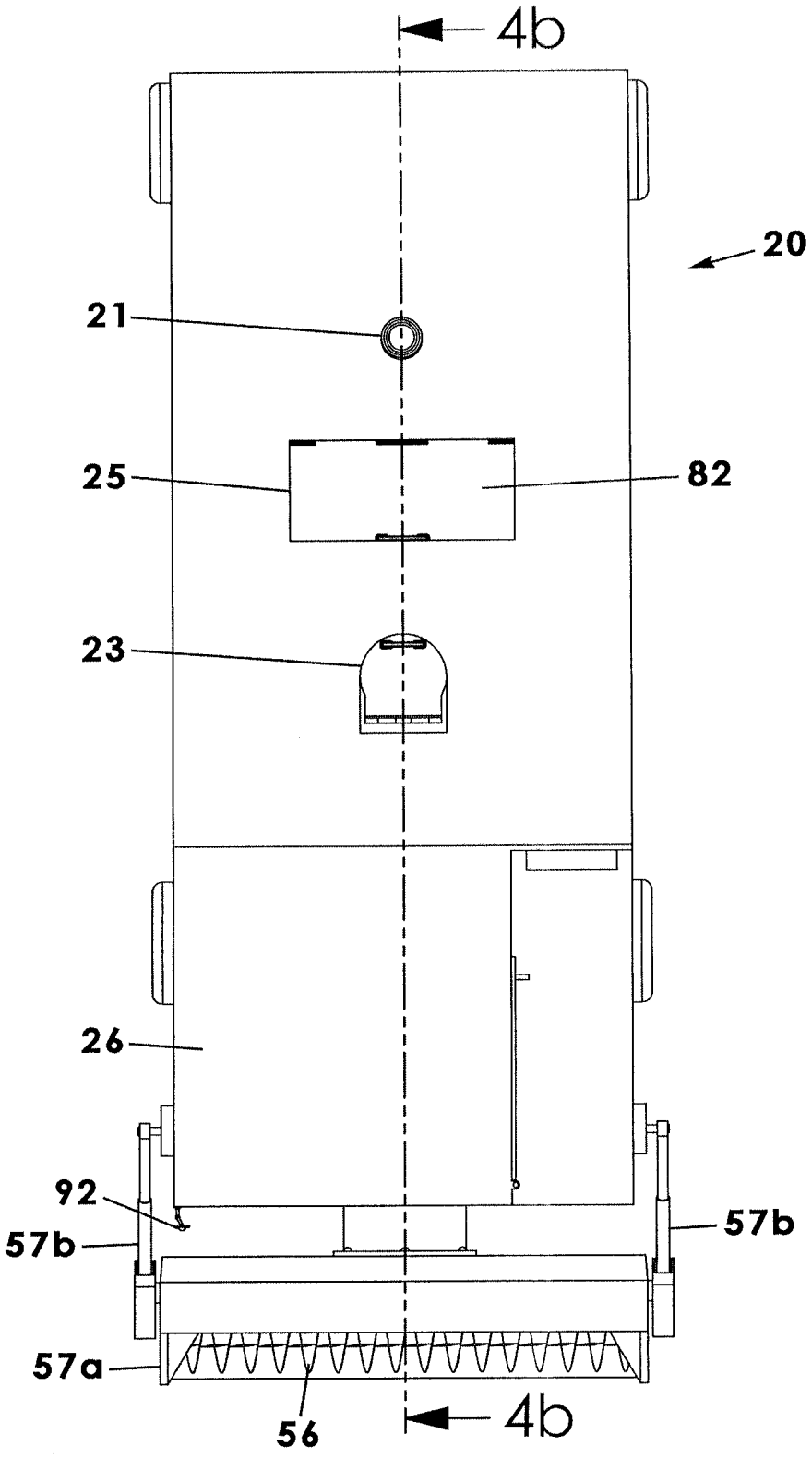
FIG. 4*a* is a top view of the vehicle as in FIG. 1.
Figure 4B:
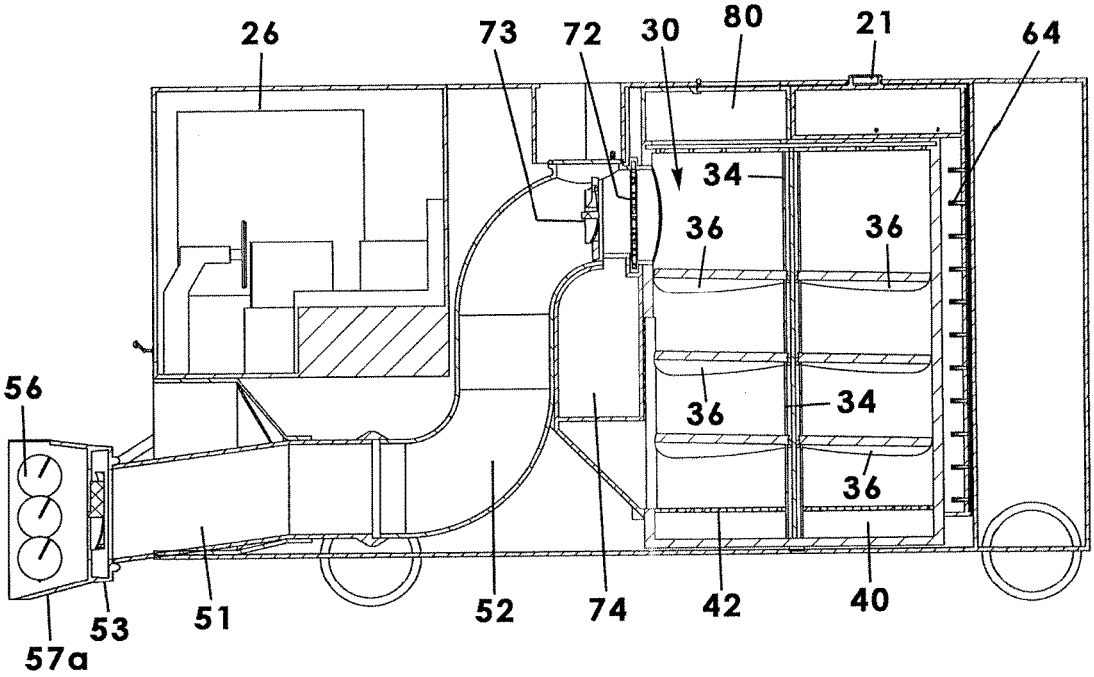
FIG. 4*b* is a sectional view taken along line 4*b*-4*b* of FIG. 4*a;*
Figure 5:
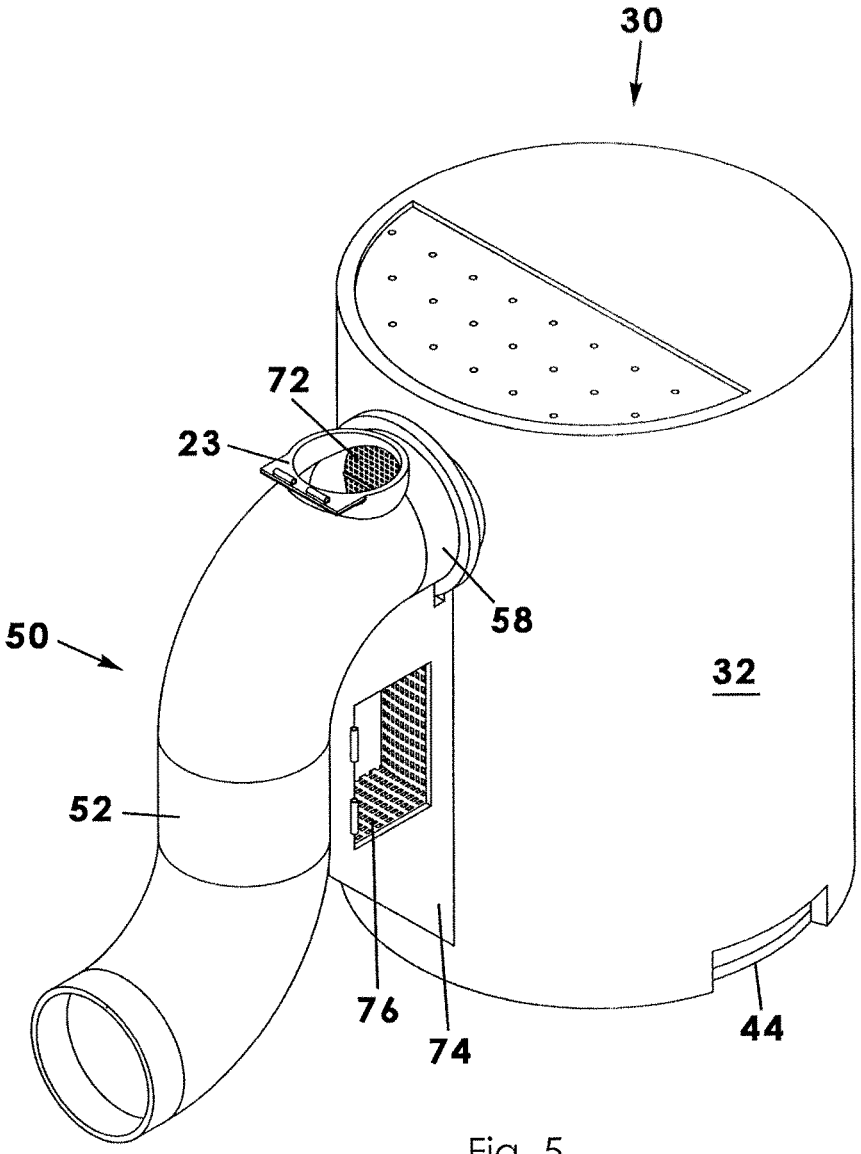
FIG. 5 is an isolated view of a collection assembly, primary chamber, and heating assembly removed from the vehicle body of FIG. 1.
Figure 6A:
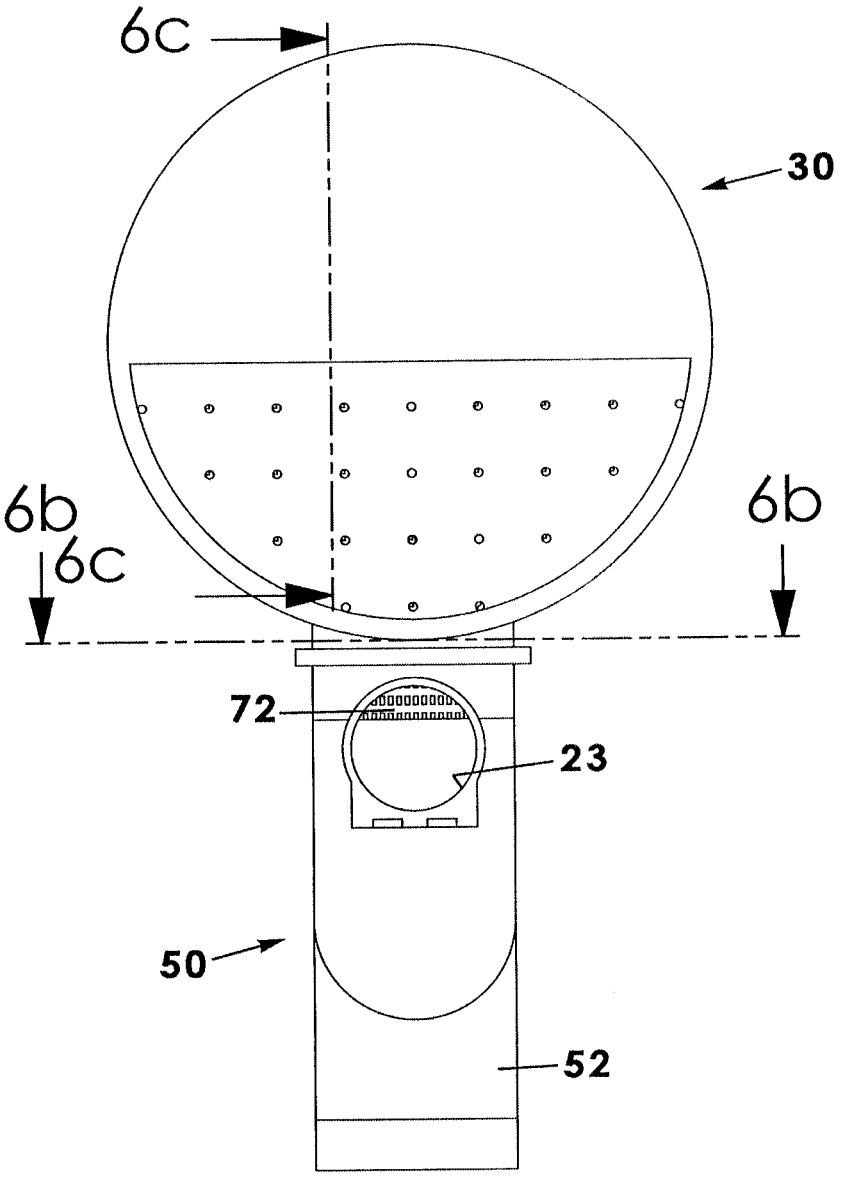
FIG. 6*a* is a top view of the assemblies illustrated in FIG. 5.
Figure 6B:
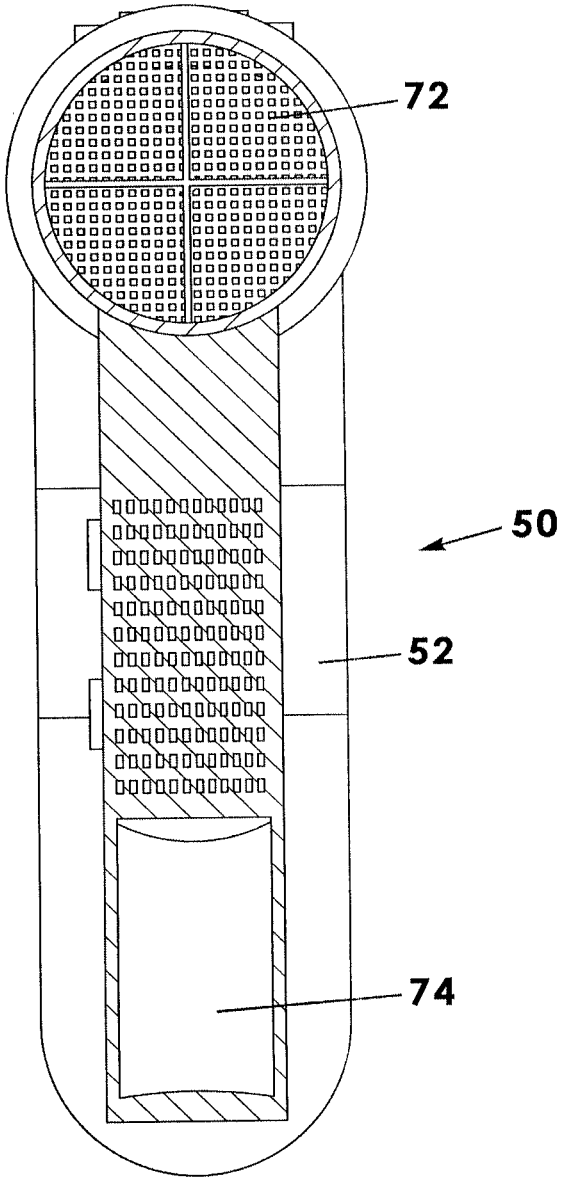
FIG. 6*b* is a sectional view taken along line 6*b*-6*b* of FIG. 6*a;*
Figure 6C:
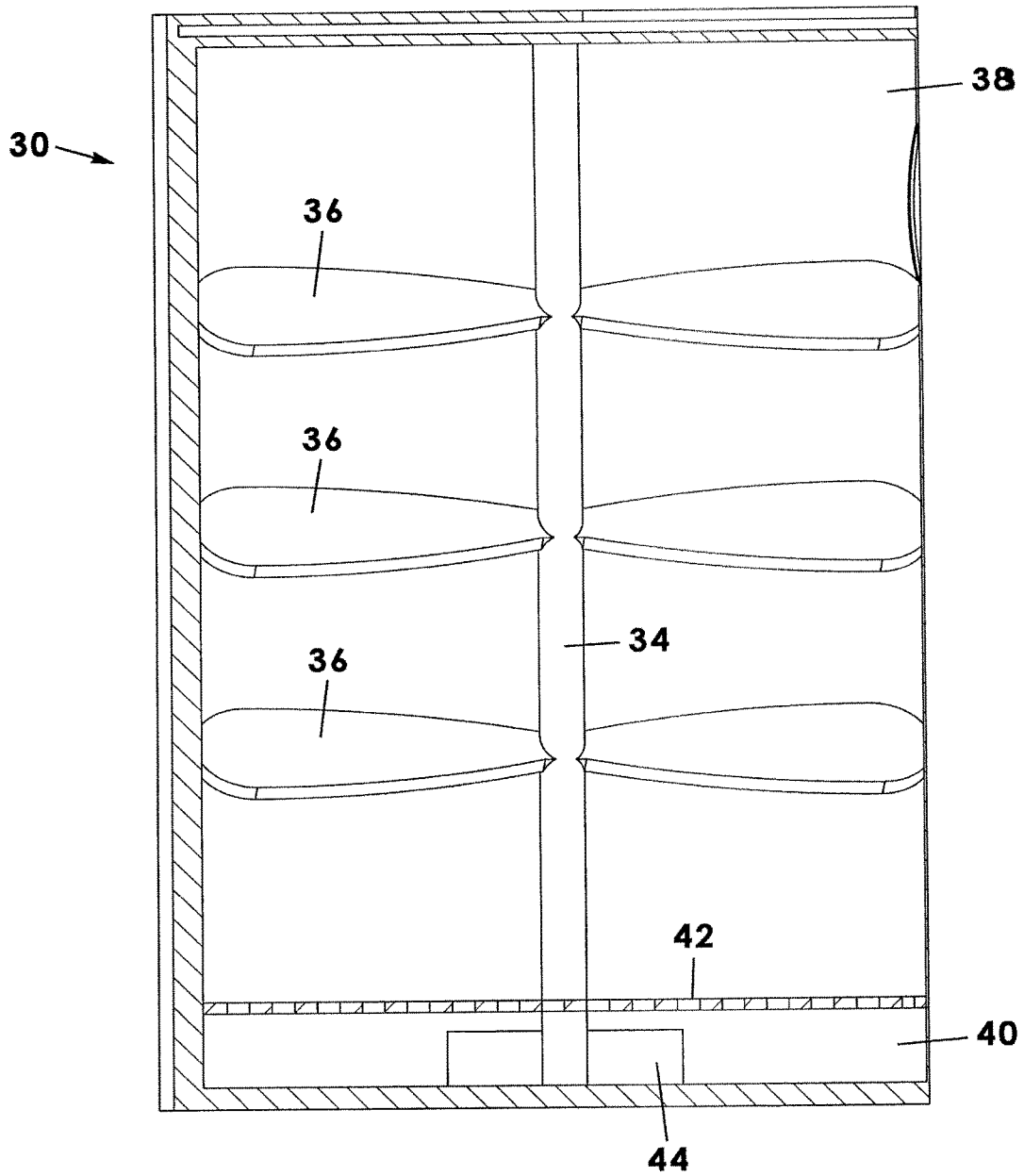
FIG. 6*c* is a sectional view taken along line 6*c*-6*c* of FIG. 6*a;*
Figure 7A:
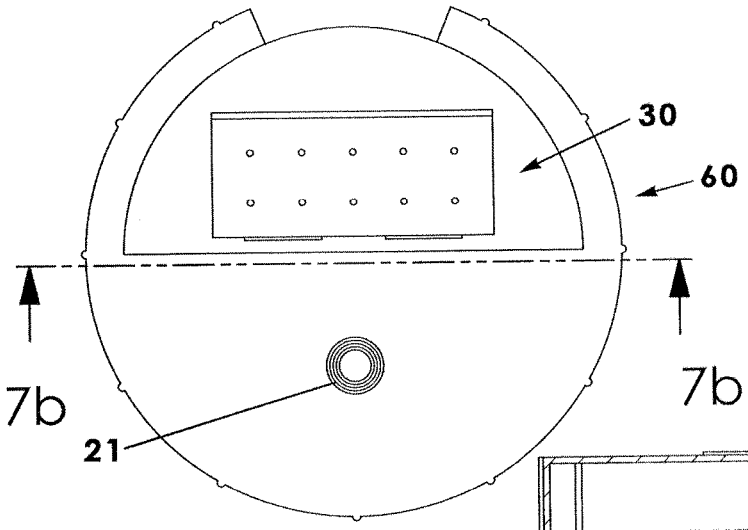
FIG. 7*a* is a top view of the heating assembly and primary chamber according to the present invention.
Figure 7B:
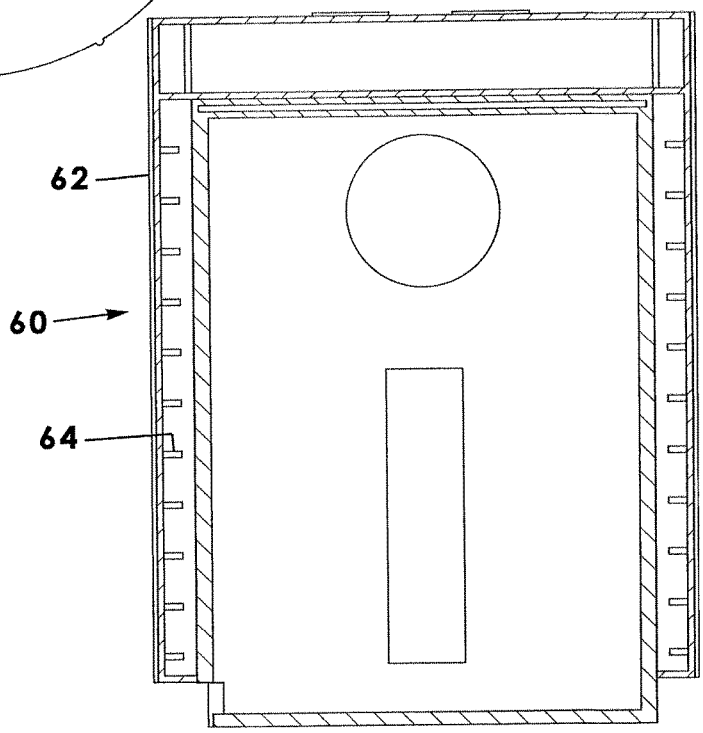
FIG. 7*b* is a sectional view taken along line 7*b*-7*b* of FIG. 7*a;*
Figure 8B:
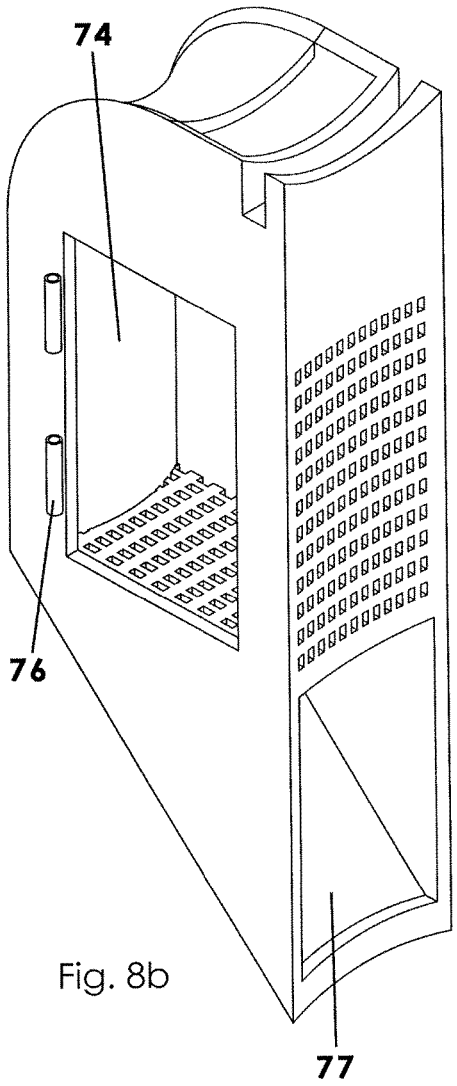
FIG. 8*b* is another perspective view of the collection chamber as in FIG. 8*b;*
Figure 8A:
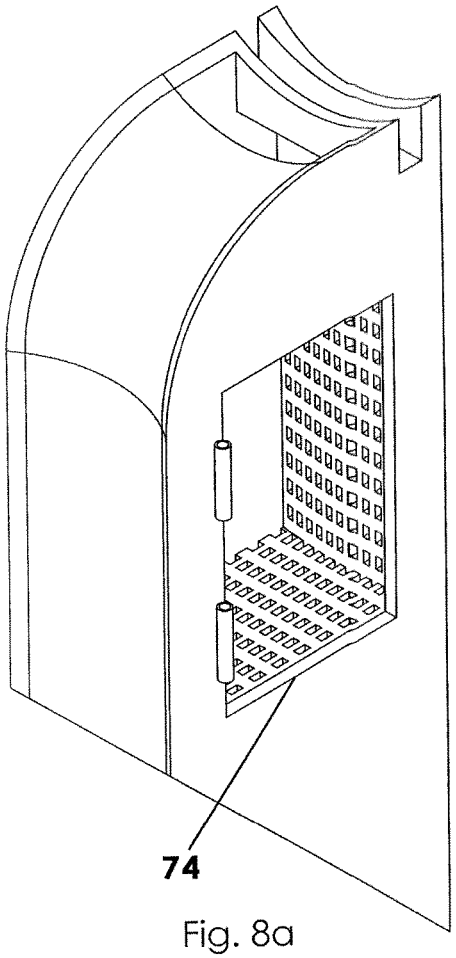
FIG. 8*a* is an isolated perspective view of the collection chamber removed from FIG. 2.
Figure 9B:
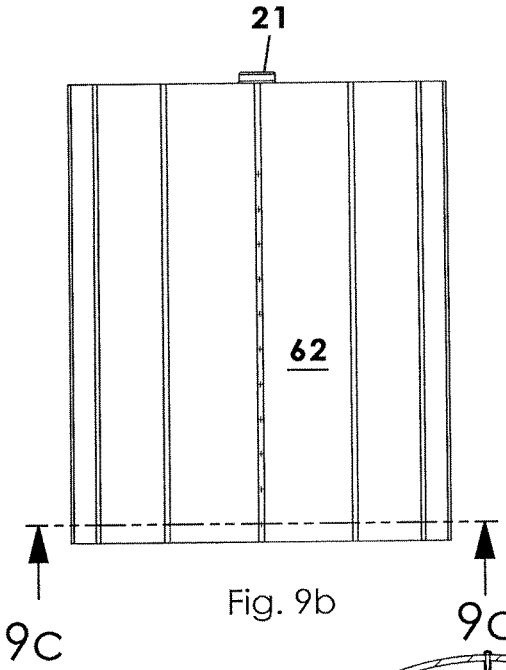
FIG. 9*b* is a sectional view taken along line 9*b*-9*b* of FIG. 9*a;*
Figure 9A:
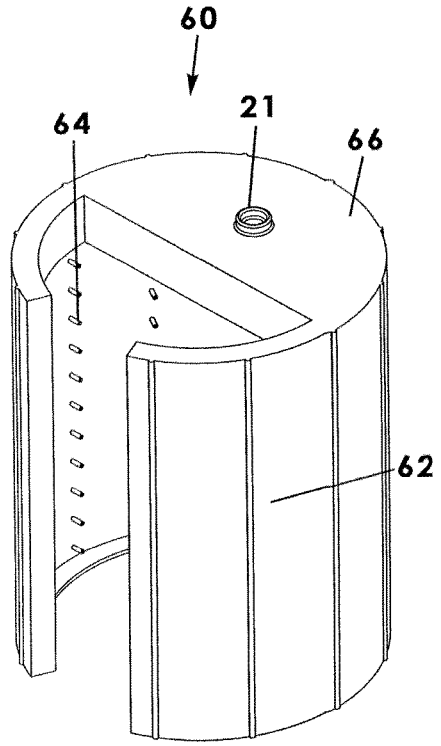
FIG. 9*a* is a perspective view of the heating assembly as in FIG. 2.
Figure 9C:
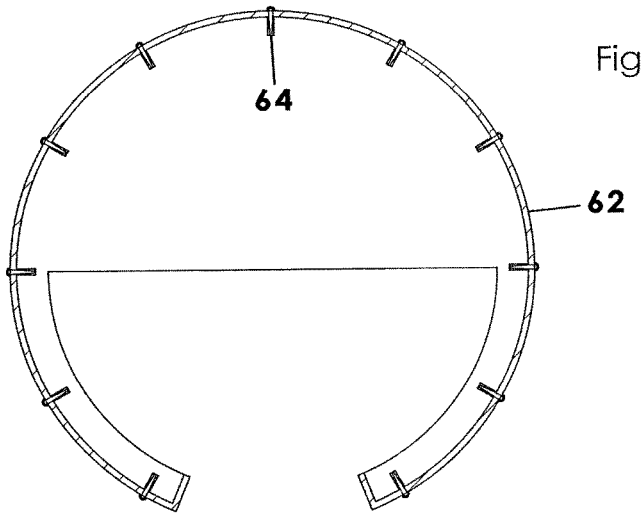
FIG. 9*c* is a sectional view taken along line 9*c*-9*c* of FIG. 9*a*.
Figure 10:
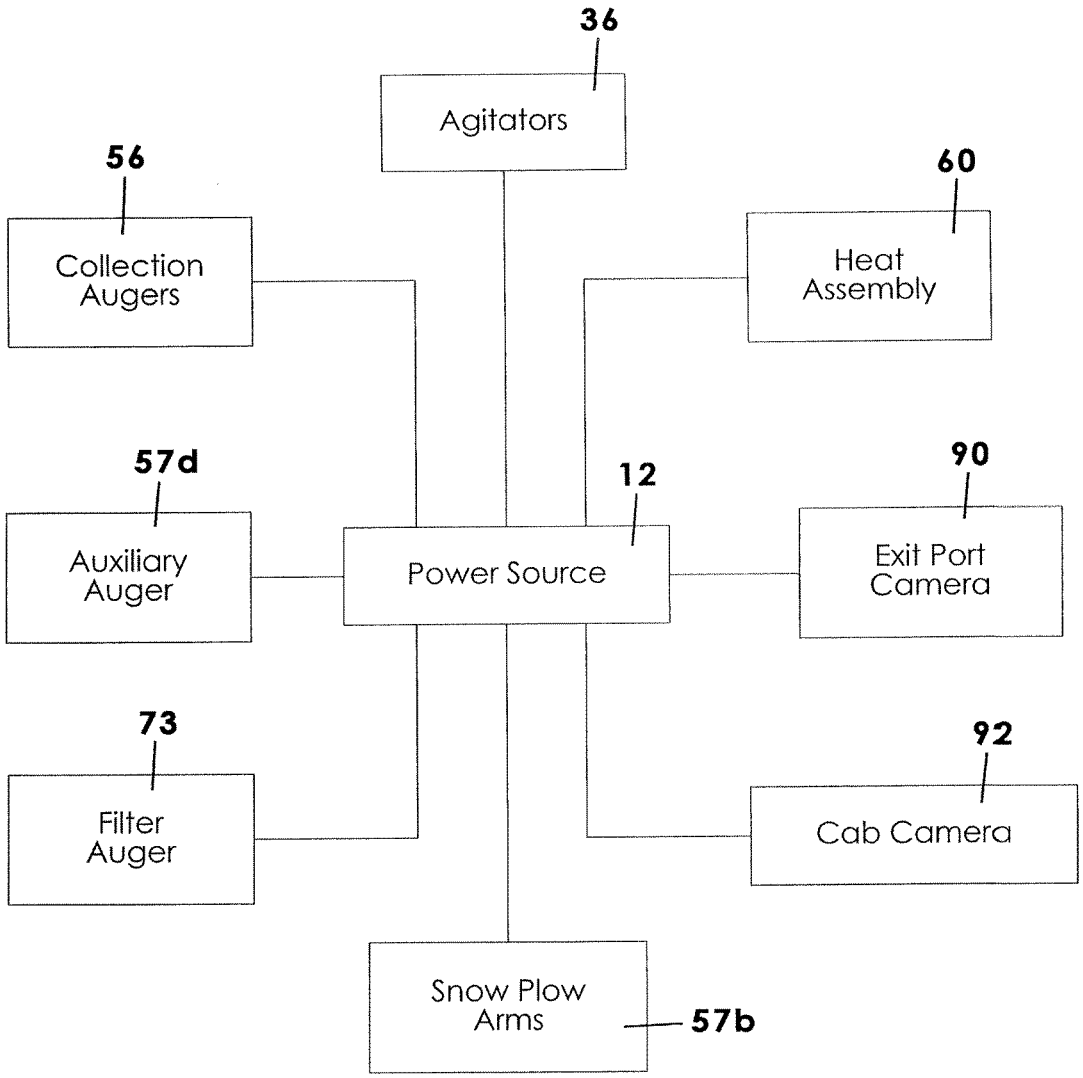
FIG. 10 is a block diagram illustrating the electrical components of the present invention.

In another aspect, the snow melting and removal vehicle 10 may include a filter assembly 70 positioned intermediate the terminal end 58 of the conduit 52 of the collection assembly 50 and an inlet opening of the primary chamber 30 (FIG. 4*b*). The filter assembly 70 may include a filter grate 72 configured to allow snow to pass into the interior area of the primary chamber 30 while blocking and preventing solid debris from entering the primary chamber 30. Debris to be blocked may include bottles, cans, sticks, toys, and other solid objects. In an embodiment, another auxiliary rotating auger, also referred to as a filter auger 73 may be positioned in or proximate the terminal end 58 of the conduit 52 and configured to rotate when actuated, the rotating filter auger 73 enhancing separation of solid debris into the collection chamber 74 and collected snow through the filter grate 72 and into the primary chamber 30.

Preferably, the filter grate 72 is upstanding or extends vertically upwardly. The filter grate 72 is rotatably coupled to one of the conduit 52 or primary chamber 30. The filter assembly 70 may include a collection chamber 74 downwardly proximate the filter grate 72 and in operative communication therewith, such as via a chute or channel (FIG. 4*b*). It is understood that debris blocked by the rotating filter grate 72 falls into the collection chamber 74. The collection chamber 74 may include a collection chamber door 76 that is movable between open and closed configurations such that collected debris may be removed by a user. The vehicle body 20 may include a corresponding port 77 that provides access to the collection chamber door 76. In addition, the top wall 22 of the vehicle body 20 defines an inspection port 23 in communication with the conduit 52 proximate the filter assembly 70 so that blockage by debris can be observed and cleaned out.

In another aspect, the primary chamber 30 defines an upper opening the allows access into the open area of the primary chamber 30. A snow melt reservoir 80 is upwardly adjacent the primary chamber 30 and contains snow melt material. Preferably, the snow melt material includes calcium chloride although other substances that are capable of depressing the freezing point of water so as to prevent ice formation may also be used, such as urea or potassium chloride. The snow melt reservoir 80 is configured to selectively release or deposit the snow melt material into the open area of the primary chamber 30 via the upper opening of the primary chamber 30. The snow melt material has the effect of causing the collected snow to melt more quickly than it would without the additive.

The snow melt reservoir 80 may include a reservoir door 82 that is selectively movable between open and closed configurations such that the snow melt reservoir 80 may be refilled with more snow melt material as needed. In addition, the top wall 22 of the vehicle body 20 defines a refill port 25 in communication with the reservoir door 82 so that snow melt material is easy to add.

Figure 1B:
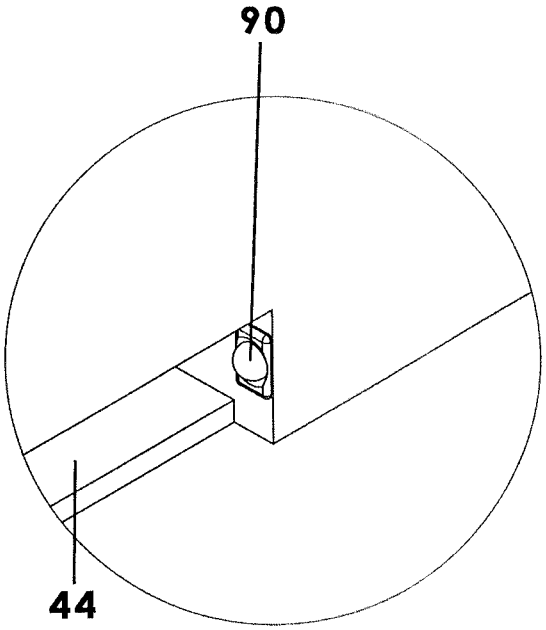
FIG. 1*b* is an isolated view on an enlarged scale taken from FIG. 1*a* illustrating an exit port camera.

In yet another aspect, the snow melting and removal vehicle 10 may include one or more cameras strategically located to assist the driver of the vehicle in having an awareness of the vehicle's position on a roadway and operation of the vehicle's components. More particularly, an exit port camera 90 may be positioned proximate the outlet opening 44 of the primary chamber 30 and in data communication with a display in the cabin. As best shown in FIG. 1*b*, the exit port camera 90 is positioned to enable the driver to confirm that the outlet opening 44 is free of obstructions and properly positioned for the release of water from melted snow as described above.

Figure 1C:
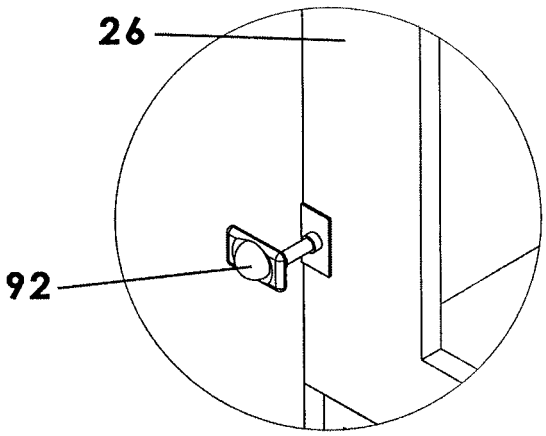
FIG. 1*c* is an isolated view on an enlarged scale taken from FIG. 1*a* illustrating a front cab camera.
Figure 2:
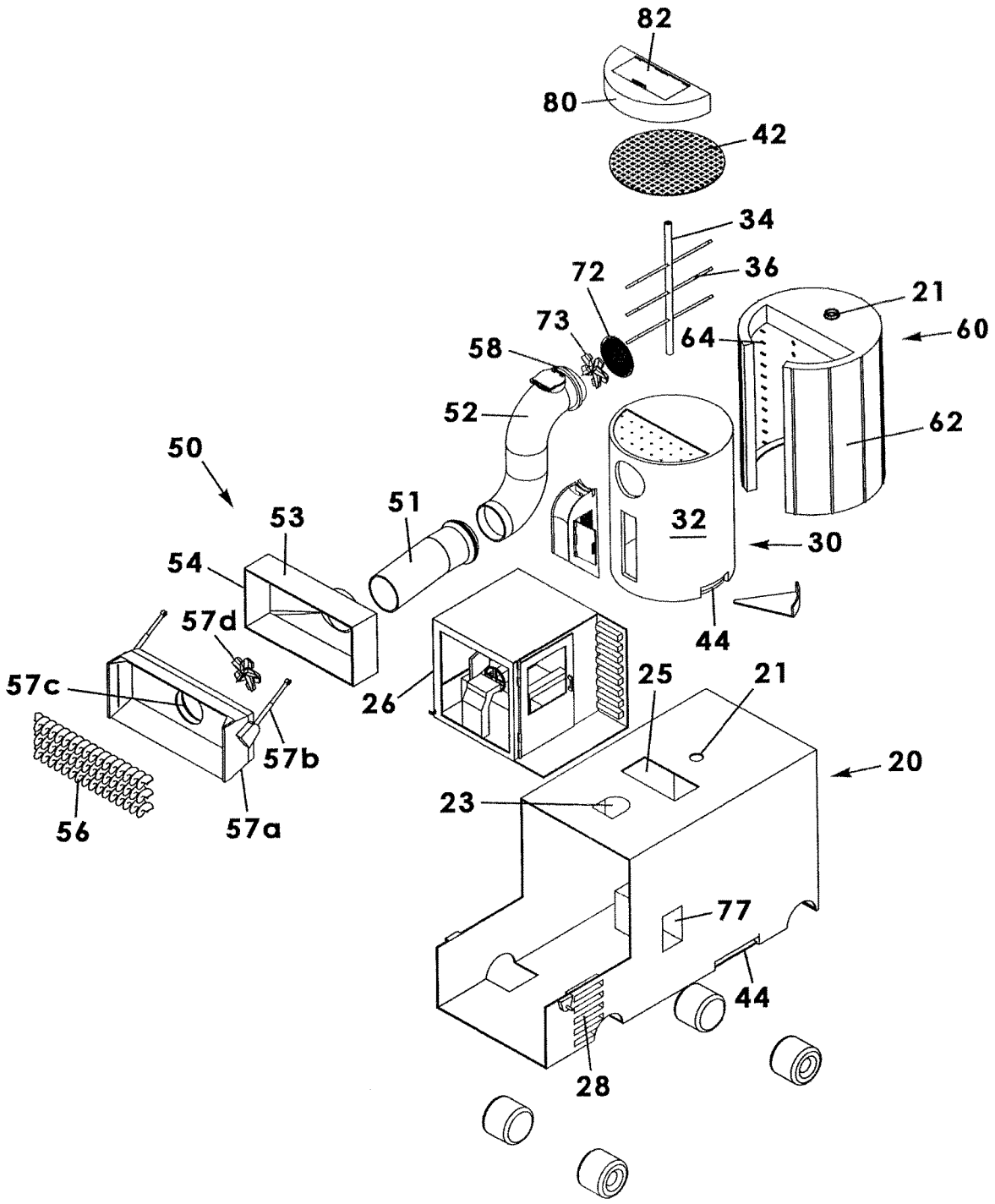
FIG. 2 is an exploded view of the vehicle as in FIG. 1.
Figure 3:
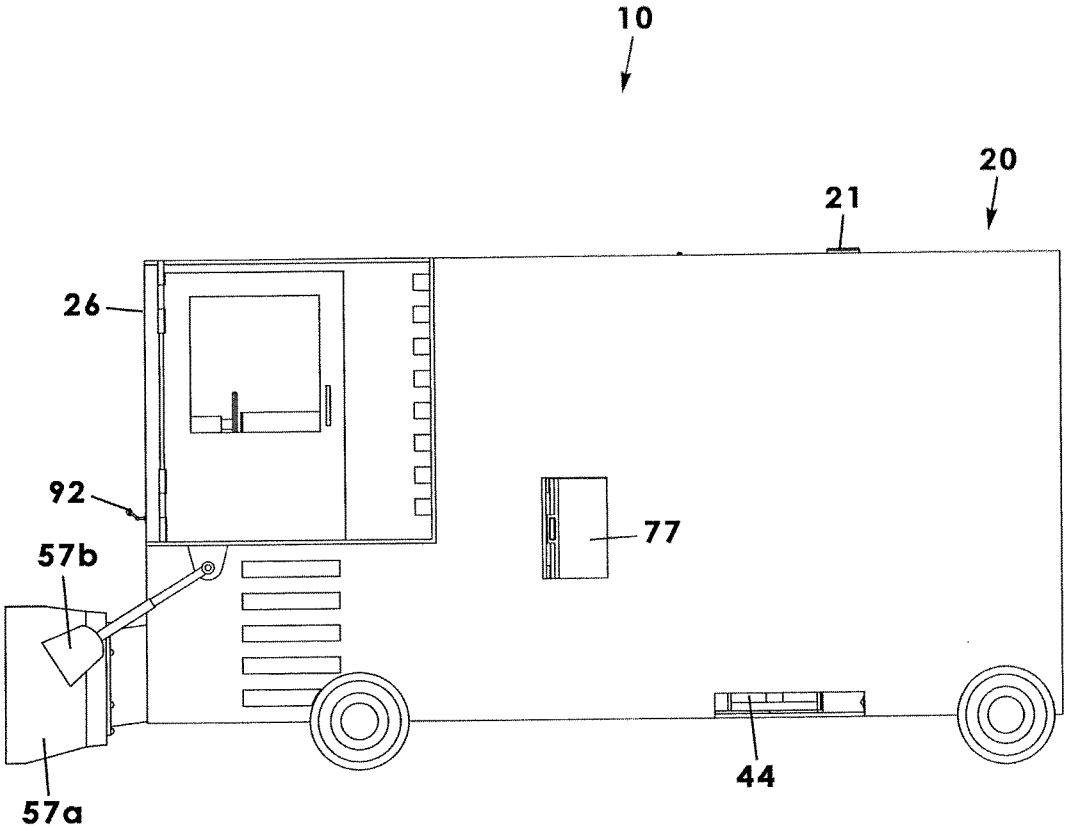
FIG. 3 is a side view of the vehicle as in FIG. 1.

Similarly, a cab camera 92 may be mounted to the vehicle body 20 proximate to the cabin and in data connection with a display in the cabin 26. As shown in FIGS. 1*a* and 1*c*, the cab camera 92 enables a driver to view the curb and street directly in front or to the side of the vehicle as it collects snow from a roadway.

In use, the plurality of augers 56 may be actuated and the vehicle itself operated in a forward direction to engage snow that needs to cleared, such as on a city street after a snow storm. Snow collected by the plurality of augers 56 is directed through the conduit 52 and into the primary chamber 30. The rotating filter assembly 70 blocks non-snow material (e.g. solid debris) from passing out of the conduit 52 into the primary chamber 30. Snow melt material may be deposited in the primary chamber 30 and the heating assembly 60 may be actuated to impart heat to the primary chamber 30. In addition, the counter-rotating agitator members 36 may agitate the collected snow. When sufficient collected snow has been melted, it may be released from the primary chamber 30 as described above.

It is understood that while certain forms of this invention have been illustrated and described, it is not limited thereto except insofar as such limitations are included in the following claims and allowable functional equivalents thereof.

The invention claimed is:

1. A snow melting and removal vehicle for collecting snow from a ground surface, comprising:

a vehicle body;

a propulsion assembly operatively mounted to said vehicle body for selectively moving said vehicle body along the ground surface;

a primary chamber situated inside said vehicle and defining an open area;

a collection assembly in fluid communication with said primary chamber that includes at least one collection auger configured to collect the snow from the ground surface and deposit the snow into said open area of said primary chamber;

a heating assembly adjacent said primary chamber and configured to impart heat to said primary chamber when energized so as to melt the snow deposited into said primary chamber;

wherein said primary chamber and said vehicle body define outlet openings, respectively, configured to release the melted snow away from said primary chamber and said vehicle body; and a filter assembly positioned intermediate said collection assembly and said primary chamber, said filter assembly having a filter grate rotatably coupled to said primary chamber and configured to rotate when energized and to block solid debris from passing into said open area of said primary chamber;

wherein said filter assembly includes a collection chamber downwardly adjacent said filter grate and in operative communication therewith, said collection chamber configured to collect solid debris blocked by said filter grate;

wherein the primary chamber includes:

a rod centrally situated in said open area of said primary chamber and extending vertically so as to define an imaginary vertical axis; and a plurality of counter-rotating agitator members axially coupled to said rod and rotatable about said vertical axis;

wherein each agitator member being spaced apart from and rotating in an opposite direction relative to an immediately adjacent agitator member, respectively.

2. The snow melting and removal vehicle as in claim 1, wherein said collection assembly includes a conduit extending between said at least one collection auger and an inlet opening defined by said primary chamber, said conduit being configured to carry the snow from said at least one collection auger to said primary chamber.

3. The snow melting and removal vehicle as in claim 1, wherein said primary chamber includes:

an upper chamber portion in containing said plurality of agitator members;

a lower chamber portion downwardly adjacent said upper chamber portion and in fluid communication therewith; and a primary chamber grate intermediate said upper chamber portion and said lower chamber portion, said primary chamber grate being configured being permeable only by melted snow.

4. The snow melting and removal vehicle as in claim 3, wherein said lower chamber portion of said primary chamber is in fluid communication with said outlet opening of said vehicle body so as to selectively expel the melted ice from the primary chamber.

5. The snow melting and removal vehicle as in claim 1, wherein said heating assembly includes:

a housing having a generally cylindrical configuration that substantially surrounds said primary chamber;

a propane container positioned adjacent said primary chamber; and a plurality of nozzles spaced apart along an inner surface of said housing and in fluid communication with said propane container, said plurality of nozzles configured to impart propane heat to said primary chamber when actuated.

6. The snow melting and removal vehicle as in claim 1, wherein:

said primary chamber includes an upper opening that allows access to said open area of said primary chamber; and said snow melting and removal vehicle includes a snow melt reservoir upwardly adjacent said primary chamber that contains snow melt material, said snow melt reservoir being configured to selectively deposit the snow melt material into said open area of said primary chamber via said upper opening.

7. The snow melting and removal vehicle as in claim 1, wherein:

said collection chamber includes a collection door selectively movable between open and closed configurations so as to selectively allow access an interior of said collection chamber; and said vehicle body defines a collection port that enables access to said collection door and said collection chamber.

8. The snow melting and removal vehicle as in claim 6, wherein:

said snow melt reservoir includes a reservoir door selectively movable between open and closed configurations so as to selectively allow access to said reservoir for refilling the snow melt material; and said vehicle body defines a snow melt refill port that enables access to said reservoir door so that the snow melt material is refilled.

9. The snow melting and removal vehicle as in claim 2, wherein a top wall of said vehicle body defines an inspection port in communication with said conduit adjacent said filter assembly, said inspection port being configured to allow any material obstruction in said conduit to be manually removed.

10. A snow melting and removal vehicle for collecting snow from a ground surface, comprising:

a vehicle body having a top wall and a plurality of side wall extending downwardly from peripheral edges of said top wall;

a propulsion assembly operatively mounted to said vehicle body for selectively moving said vehicle body along the ground surface, said propulsion assembly including a motor, wheels, and a steering mechanism;

a primary chamber situated inside said vehicle and defining an open area, said primary chamber having a continuous side wall defining a generally cylindrical configuration;

a collection assembly in fluid communication with said primary chamber that includes at least one collection auger configured to collect the snow from the ground surface and deposit the snow into said open area of said primary chamber;

wherein said collection assembly includes a conduit extending between said at least one collection auger and an inlet opening defined by said primary chamber, said conduit being configured to carry the snow from said at least one collection auger to said primary chamber;

a heating assembly surrounding said side wall of said primary chamber and configured to impart heat to said primary chamber when energized so as to melt the snow deposited into said primary chamber;

wherein said primary chamber and said vehicle body define outlet openings, respectively, configured to release the melted snow away from said primary chamber and said vehicle body; and a filter assembly positioned intermediate said collection assembly and said primary chamber, said filter assembly having a filter grate rotatably coupled to said primary chamber proximate a terminal end of said conduit and configured to rotate when energized and to block solid debris from passing into said open area of said primary chamber;

wherein said filter assembly includes a collection chamber downwardly adjacent said filter grate and in operative communication therewith, said collection chamber configured to collect solid debris blocked by said filter grate;

wherein the primary chamber includes:

a rod centrally situated in said open area of said primary chamber and extending vertically so as to define an imaginary vertical axis; and a plurality of counter-rotating agitator members axially coupled to said rod and rotatable about said vertical axis;

wherein each agitator member being spaced apart from and rotating in an opposite direction relative to an immediately adjacent agitator member, respectively.

11. The snow melting and removal vehicle as in claim 10, wherein said top wall of said vehicle body defines an inspection port in communication with said conduit adjacent said filter assembly, said inspection port being configured to allow any material obstruction in said conduit to be manually removed.

12. The snow melting and removal vehicle as in claim 10, wherein said primary chamber includes:

an upper chamber portion in containing said plurality of agitator members;

a lower chamber portion downwardly adjacent said upper chamber portion and in fluid communication therewith; and a primary chamber grate intermediate said upper chamber portion and said lower chamber portion, said primary chamber grate being configured being permeable only by melted snow.

13. The snow melting and removal vehicle as in claim 12, wherein said lower chamber portion of said primary chamber is in fluid communication with said outlet opening of said vehicle body so as to selectively expel the melted ice from the primary chamber.

14. The snow melting and removal vehicle as in claim 10, wherein said heating assembly includes:

a housing having a generally cylindrical configuration that substantially surrounds said primary chamber;

a propane container positioned adjacent said primary chamber; and a plurality of nozzles spaced apart along an inner surface of said housing and in fluid communication with said propane container, said plurality of nozzles configured to impart propane heat to said primary chamber when actuated.

15. The snow melting and removal vehicle as in claim 10, wherein:

said primary chamber includes an upper opening that allows access to said open area of said primary chamber; and said snow melting and removal vehicle includes a snow melt reservoir upwardly adjacent said primary chamber that contains snow melt material, said snow melt reservoir being configured to selectively deposit the snow melt material into said open area of said primary chamber via said upper opening.

16. The snow melting and removal vehicle as in claim 10, wherein:

said collection chamber includes a collection door selectively movable between open and closed configurations so as to selectively allow access to an interior of said collection chamber; and said vehicle body defines a collection port that enables access to said collection door and said collection chamber.

17. The snow melting and removal vehicle as in claim 15, wherein:

said snow melt reservoir includes a reservoir door selectively movable between open and closed configurations so as to selectively allow access to said reservoir for refilling the snow melt material; and said vehicle body defines a snow melt refill port that enables access to said reservoir door so that the snow melt material is refilled.

18. The snow melting and removal vehicle as in claim 10, wherein:

said collection assembly includes a snow plow member pivotally coupled to said vehicle body for selectively moving independently of said vehicle body;

said at least one collection auger is situated in said snow plow member such that snow passing through said at least one collection auger is delivered into said conduit.

19. The snow melting and removal vehicle as in claim 18, further comprising:

an auxiliary auger associated with said snow plow member for urging the collected snow from said snow plow member to said conduit; and a filter auger positioned upstream and proximate to said filter grate and configured to urge the solid debris into said collection chamber and collected snow into said primary chamber.

20. The snow melting and removal vehicle as in claim 10, further comprising:

a exit port camera positioned proximate said outlet port of said primary chamber, said exit port camera being in data communication with a display situated in a cabin of said vehicle body; and a cab camera mounted to an exterior surface of said cabin of said vehicle body, said cab camera being in data communication with said display in said cabin of said vehicle body.

* * * * *